US011844405B1

(12) United States Patent
Dry

(10) Patent No.: US 11,844,405 B1
(45) Date of Patent: Dec. 19, 2023

(54) DECORATIVE ASSEMBLIES FOR USE WITH CLOTHING

(71) Applicant: THE PATENT WELL LLC, Fort Worth, TX (US)

(72) Inventor: Alex Dry, Los Angeles, CA (US)

( * ) Notice: Subject to any disclaimer, the term of this patent is extended or adjusted under 35 U.S.C. 154(b) by 86 days.

(21) Appl. No.: 17/450,216

(22) Filed: Oct. 7, 2021

Related U.S. Application Data

(60) Provisional application No. 63/198,289, filed on Oct. 8, 2020.

(51) Int. Cl.
*A44C 25/00* (2006.01)

(52) U.S. Cl.
CPC ..... *A44C 25/00* (2013.01)

(58) Field of Classification Search
CPC ..... A44C 25/00; A44C 13/00; A44C 15/0095; A44C 15/005; A44C 11/00
See application file for complete search history.

(56) References Cited

U.S. PATENT DOCUMENTS

| | | | | |
|---|---|---|---|---|
| 1,446,179 | A * | 2/1923 | Henkes | A44C 11/00 63/23 |
| 1,491,578 | A * | 4/1924 | Ballou | A41F 15/002 63/3.2 |
| 6,086,451 | A * | 7/2000 | Fernandes | A41F 15/002 450/86 |
| 6,098,202 | A * | 8/2000 | Peck | A44C 11/00 63/3.1 |
| 7,406,840 | B2 * | 8/2008 | Brancato | A44C 11/007 63/3 |
| 8,261,373 | B2 * | 9/2012 | Detsis | A44C 5/0053 2/323 |

* cited by examiner

*Primary Examiner* — Jack W Lavinder

(57) ABSTRACT

An assembly for use with swimsuits and other articles of clothing, the assembly comprising decorative chains and clasps for removably coupling the chains to swimwear and/or other articles of clothing.

9 Claims, 9 Drawing Sheets

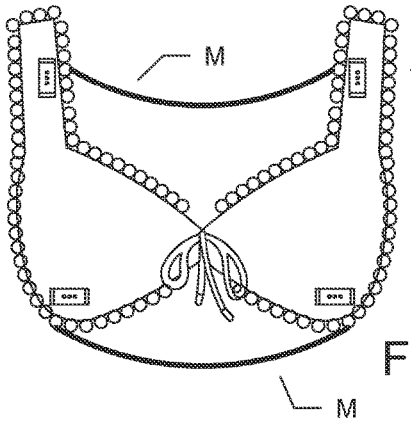
Fig. 7C
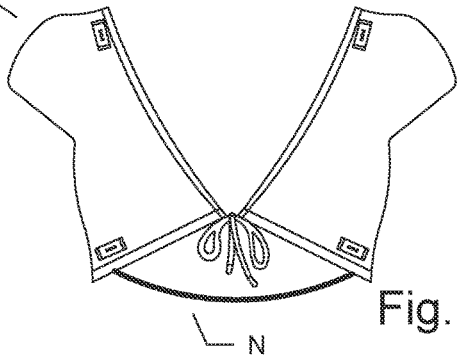
Fig. 7D
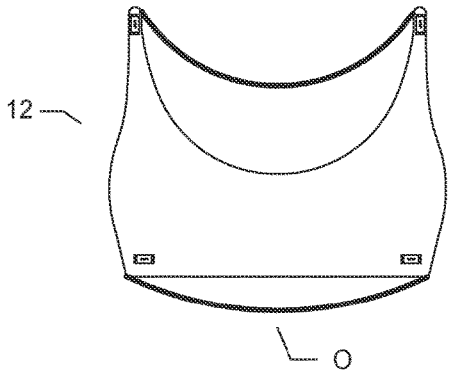
Fig. 7E
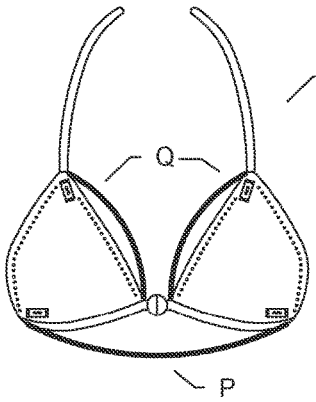
Fig. 7F
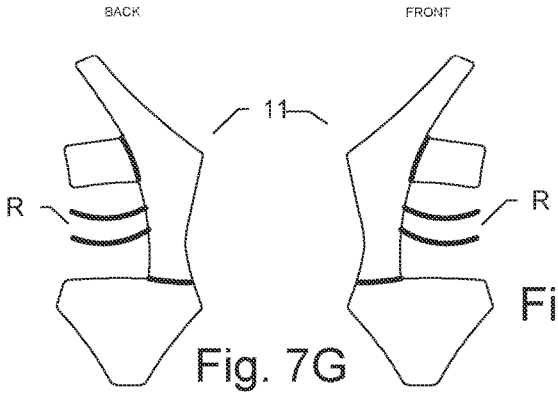
Fig. 7G
Fig. 7H

DECORATIVE ASSEMBLIES FOR USE WITH CLOTHING

RELATED APPLICATIONS

This application claims the benefit of, priority to, and incorporates by reference provisional application #63/198,289, filed Oct. 8, 2020.

FIELD OF THE INVENTION

Decorative assemblies for use with swimwear and/or articles of clothing, including decorative chains with means for removably attaching the chains to the garment.

BACKGROUND OF THE INVENTION

Recently, it has become fashionable to adorn clothing with jewelry, including chains. However, the current designs lack certain utility, including the ability to easily remove the chains from the garment or to relocate the chains to a different position on the same garment. Moreover, the structure performing the removable function should be protected from wear. Further, when the garment is a swimsuit, additional needs may be desired including a suitable finish to a metal chain, such as a finish that will retain an attractive look while being exposed to sunlight, water, salt, and chlorine (chemical attack), as well as mechanical abrasion.

SUMMARY OF INVENTION

Applicant provides, in some embodiments, an assembly for use with a swimsuit or other garment, the assembly comprising a flexible chain and means for removably attaching the flexible chain to the garment.

The assembly chain may have two removed ends and the means for removably attaching may include a clasp capable of engaging each of the removed ends.

The assembly clasp may have a pair of brazed, toothed jaws.

The assembly clasp may include a curved sliding member and a curved body comprising a mouth.

The assembly means for removable attaching may comprise a clasp engagement means attached to a section of clothes or fabric.

The assembly clasp engagement means may include a rigid member, such as a closed loop, sewn to the clothes.

The assembly clasp engagement means may be an elastic member sewn to the clothes.

The assembly may include a pocket, such as a fabric pocket, for covering the clasp engagement means while providing access to the clasp engagement means by the clasp and covering from view the clasp and clasp engagement means.

The assembly chain may include multiple linked metal links.

The metal links may have a conversion coating, anodizing or other corrosion inhibiting coating on a surface thereof to provide a pleasing look and help diminish corrosion.

Applicant's devices allow one to easily attach or remove decorative chains from an outer or inner surface of an article of clothing or to rearrange the chains to selected locations on the garment. Applicant's invention also allows the option of removable chain to chain releasable attachment.

DETAILED DESCRIPTION OF VARIOUS EMBODIMENTS

Figure 1A:
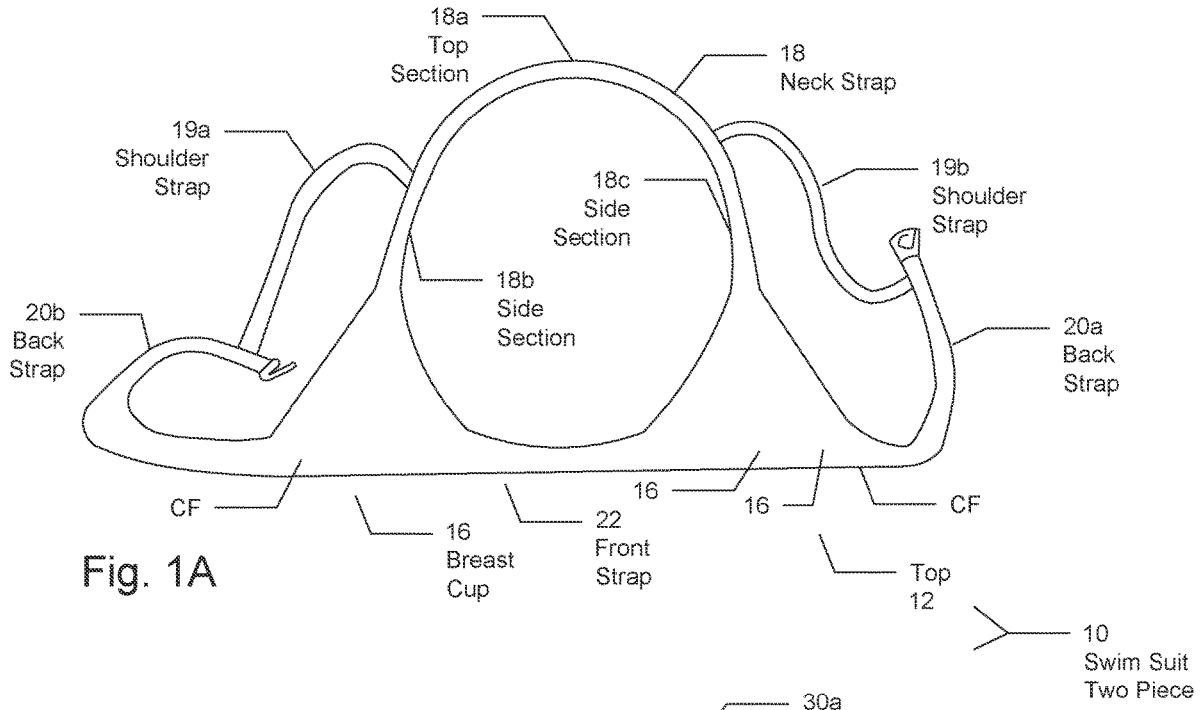
FIGS. 1A and 1B illustrate a top and bottom of a two-piece women's swimsuit.
Figure 1B:
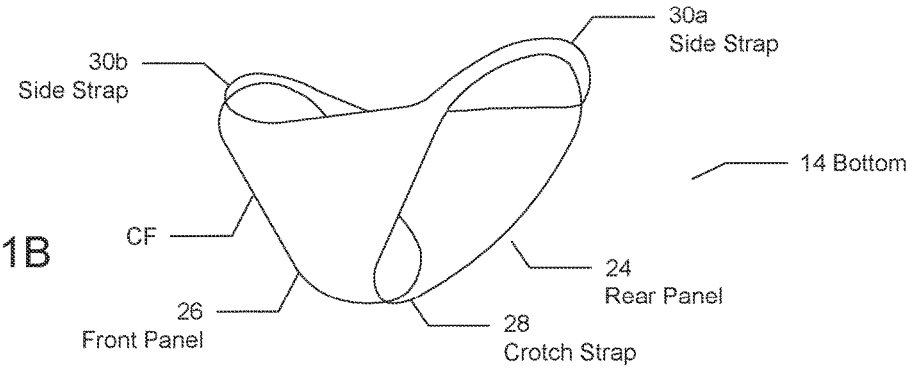

FIGS. 1A and 1B illustrate a top 12 and a bottom 14 of a two-piece women's swimsuit 10 that may be made of a cloth or fabric that may be stretchable or non-stretchable. Top 12 may include breast cups 16 and a neck strap 18 with top section 18*a* and side sections 18*b* and 18*c*, the neck strap for engaging the breast cups and encircling the neck. Back straps 20*a* and 20*b* may be provided, hooked to engage at the removed ends thereof. Sometimes, instead of a neck strap (or in addition to), shoulder, or halter straps 19*a* and 19*b* may be used to support breast cups 16. A front strap 22 is sometimes found between the breast cups.

FIG. 1B illustrates the two-piece bottom 14 having a bottom rear panel 24, a front panel 26 with, sometimes, a crotch strap 28 connecting the lower apexes of the two panels and having side straps 30*a* and 30*b*.

Figure 2A:
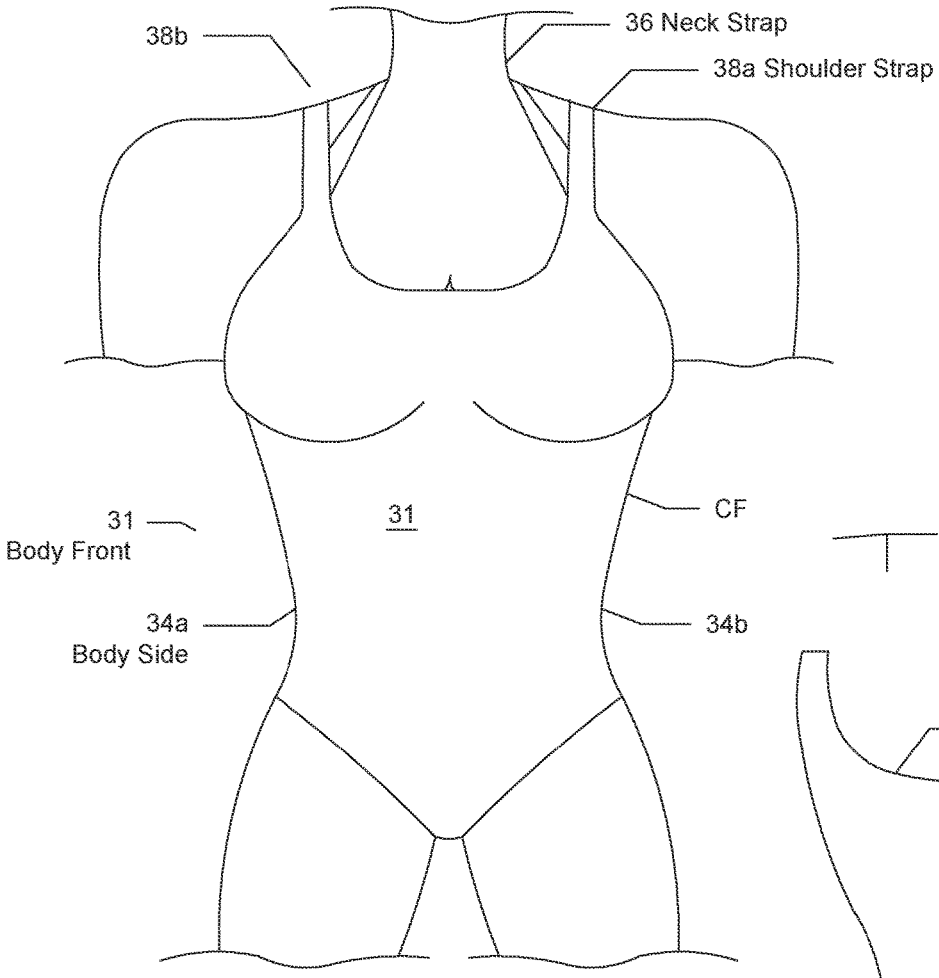
FIGS. 2A and 2B are a front and rear view of a one-piece women's swimsuit.
Figure 2B:
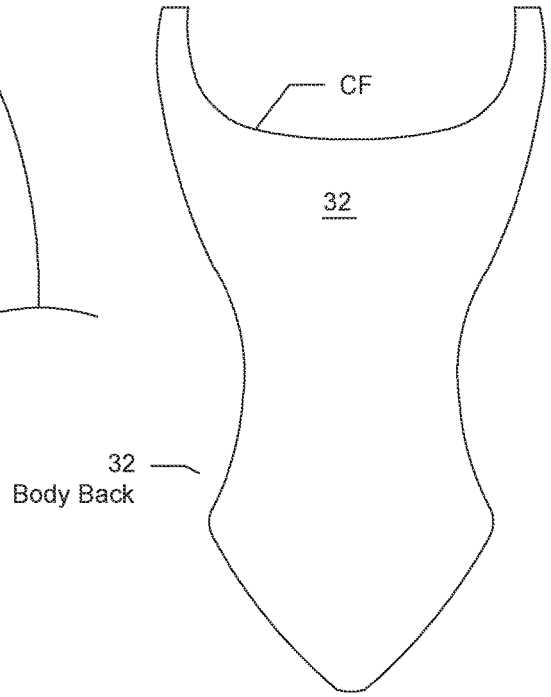

FIGS. 2A and 2B illustrate a front 31 and a rear 32, and sides 34*a* and 34*b* of a women's one-piece swimsuit 11. A neck strap 36 or shoulder (halter) straps 38*a* and 38*b* may be used to support front 31.

These illustrations will be helpful in illustrating manner and various locations in which applicants' ornamental chains may engage the garments.

Figure 3A:
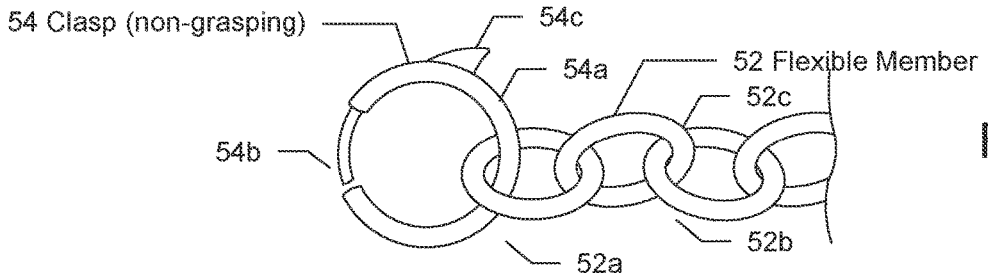
FIGS. 3A and 3B illustrate two embodiments of chain clasps.
Figure 3B:
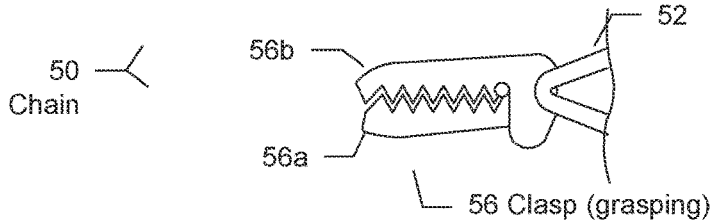

FIGS. 3A and 3B illustrate applicant's chains 50 here comprising at least a flexible member 52 which in some embodiments may include multiple individual links 52*c* such as metal links. Chain 50 may include end links 52*a* and a body 52*b* which has individual links inter-looped with two adjacent links. Chains may be made of any suitable metallic or non-metallic material.

Applicant provides a novel coupling means 70 (FIGS. 5A, 5B and 5C) for removably attaching chain 50 to a garment, in some embodiments a one- or two-piece women's swimsuit 10/11. The coupling means may comprise a clasp 54/56, FIGS. 3A and 3B (see also FIGS. 5D-5M) for engaging a chain to a clasp engaging means 60/62 which is adapted to engage the fabric or cloth of the garment.

FIGS. 3A, 3B, 4A, 4B and 4C illustrate various complementary parts of embodiments of coupling means 70. The clasp may be a first part of coupling means 70. Clasp 54 may include a curved body 54*a* defining a mouth, which may be selectively closed by sliding mouth closure member 54*b*, over the mouth.

Hand operated lever 54*c* activates closure member 54*b*. These clasps are available and sometimes referred to as spring rings. Clasp 54 is a non-grasping clasp. Clasp 56 is a grasping clasp having jaws (56A and 56B) with teeth, spring based against one another. Such jawed clasps are commercially available. The non-grasping clasp 54 typically encircles an end link 52A of flexible member 52.

A second part of the coupling means—the clasp being the first part—is the clasp engagement means 60/62 (rigid/non-rigid) for attachment to the cloth or fabric of the garment as by threads or stitching 64. Both clasp engagement means 60/62 are adapted to engage the clasps 54/56. Clasp engagement means 60 is in some embodiments a rigid metal or non-metal loop attached to cloth or fabric by stitches. Clasp engagement means 62 may be an elastic strip of fabric attached by stitches 64 or other suitable means to cloth or fabric, see FIGS. 4A, B.

Figure 4A:
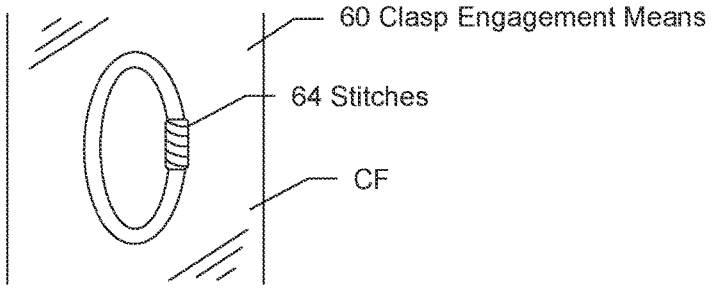
FIGS. 4A and 4B illustrate two embodiments of clasp engagement means for attachment of chains to the cloth/fabric of a swimsuit.
Figure 4B:
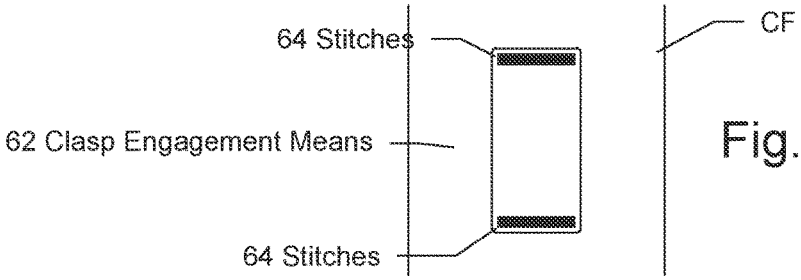
Figure 4C:
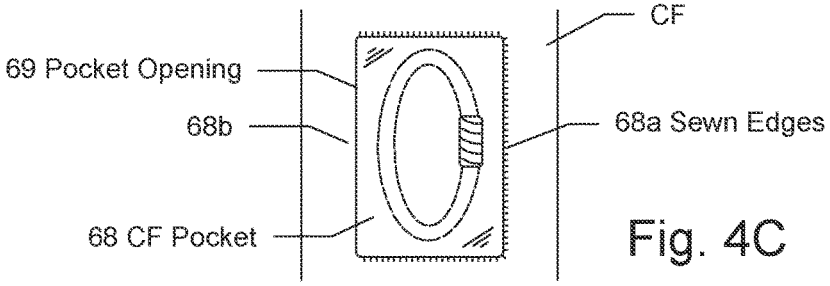
FIG. 4C illustrates a pocket to help disguise and protect the clasp engagements means.

FIG. 4C illustrates a flexible cloth or fabric pocket 68, typically comprising the same color and type of fabric as makes up the garment, with a number of sewn edges 68*a* and an unsewn portion 68*b* which comprises a pocket opening. Pocket 68 is typically dimensioned to cover up and disguise the clasp engagement means and/or the clasp when it is coupled to the clasp engagement means, it also protects these elements. The pocket is optional.

Figure 5A:
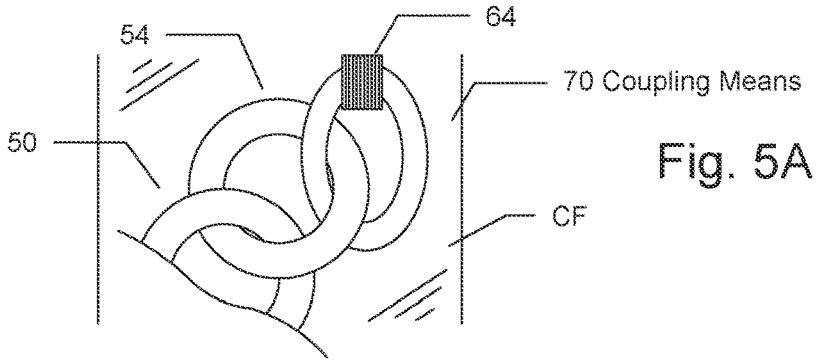
FIGS. 5A and 5B illustrate details of the manner in which coupling means allow chains to engage the cloth/fabric of a swimsuit.
Figure 5B:
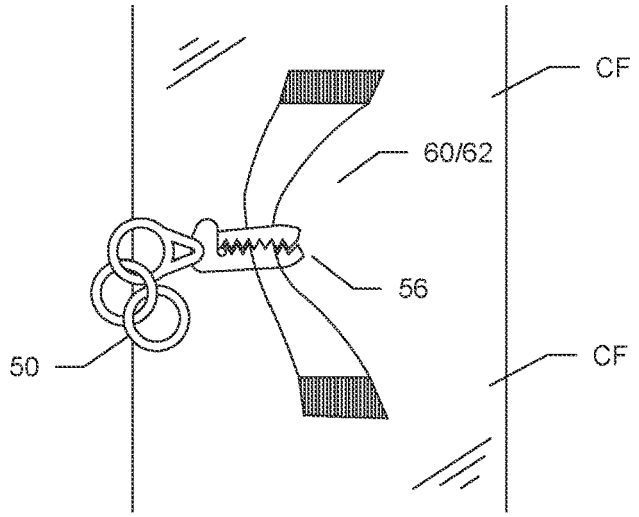
Figure 5C:
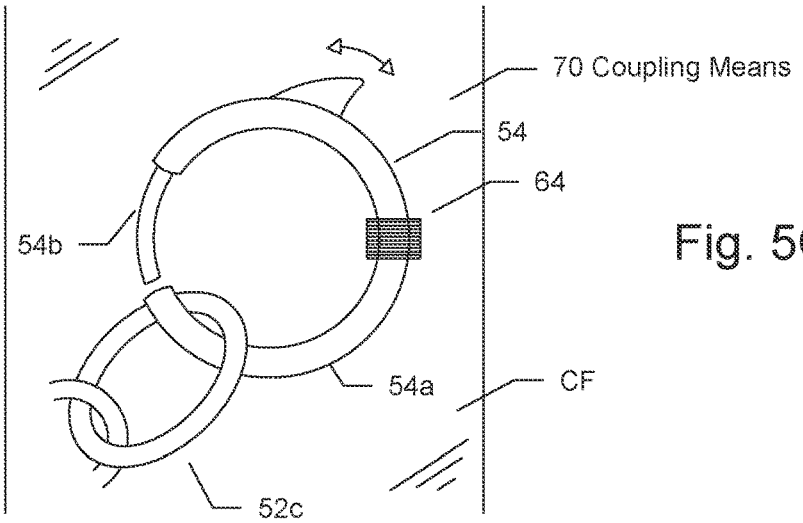
FIG. 5C illustrates a single piece embodiment of a coupling means.

FIGS. 5A, B and C illustrate coupling means 70 and the manner in which either clasps 54/56, or any other clasp, may engage either clasp engaging means 60/62 (rigid loop, non-rigid elastic) either by physical grasping, FIG. 5B or passively encircling, FIGS. 5A and 5C. FIG. 5C illustrates an embodiment where coupling means 70 comprises clasp 54 attached by stitches 64 to cloth or fabric and this is the only structure needed as clasp 54 may directly encircle a link 52C rather than engaging a clasp.

Figure 5D:
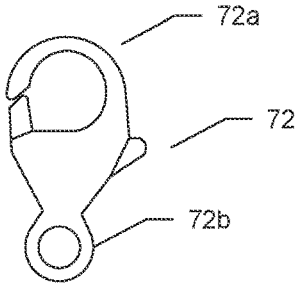
FIGS. 5D-5M illustrate a number of different clasps.

FIG. 5D illustrates a "lobster claw" clasp 72 comprising an encircling (non-grasping) portion 72*a* and a rigid loop 72*b* which may act as a coupling means when attached directly, as for example by stitches, to a garment or may be attached to a chain and engage a clasp engagement means, 60/62 for example.

Figure 5E:
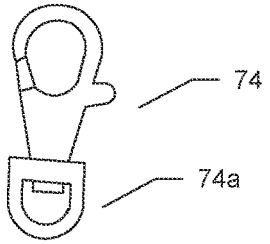

FIG. 5E illustrates another "lobster claw" clasp 74 similar to that illustrated in FIG. 5D except instead of a rigid loop 72*b*, a swivel loop 74*a* is provided.

Figure 5F:
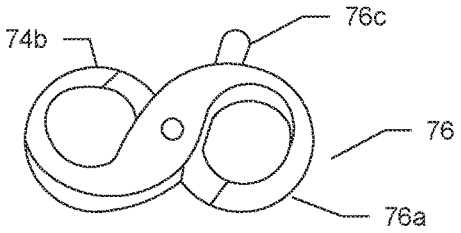
Figure 7A:
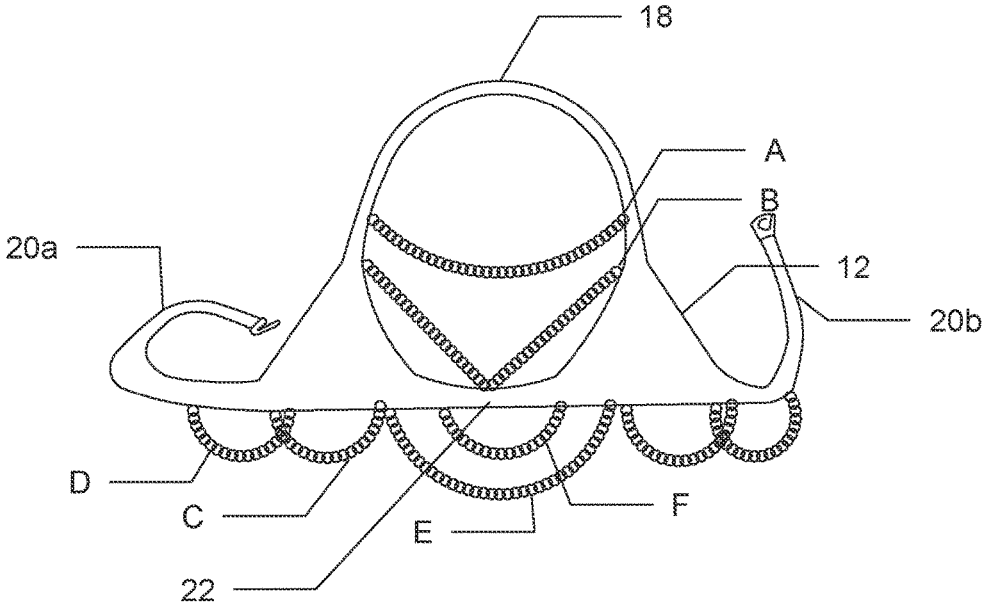
FIGS. 7A and 7N illustrate chain attachment points on a women's swimsuit.

FIG. 5F illustrates a "double action" or "figure eight" clasp 76 having two portions 76*a*/76*b* which are lever 76C operated and capable of encircling or engaging a suitable member such as a clasp engagement means and/or a link 52*a*/*c* and thus are useful to adjustably select a length of chain, see for example Chain "B" in FIG. 7A where a non-end portion of the chain is releasably engaged to the garment. Using a double action clasp, such as clasp 76 (or two clasps 54) allows positioning any non-end or end portion of the chain to the garment or another chain to achieve different looks.

Figure 5G:
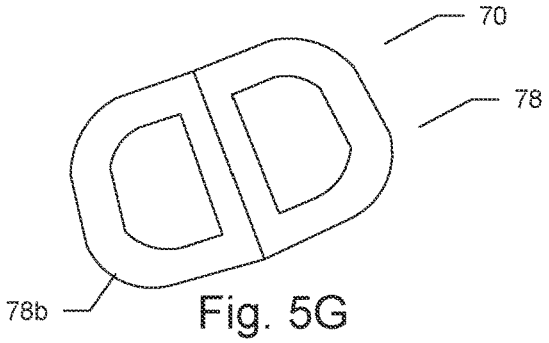
Figure 5H:
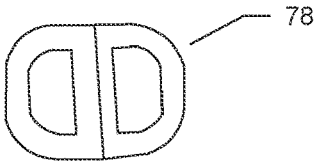
Figure 5I:
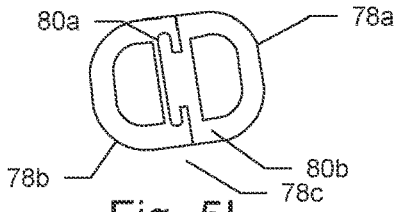

FIGS. 5G, H and I illustrate various views of a releasably hinged clasp 78 with a first portion 78*a* and a second portion 78*b* that are releasably hinged at 78*c*. Hinge 78*c* may comprise slot portion 80*b* on first portion 78*a* and male portion 80*a* on second portion 78*b*. One portion may be sewn to cloth or fabric, the other may engage chain 50.

Figure 5J:
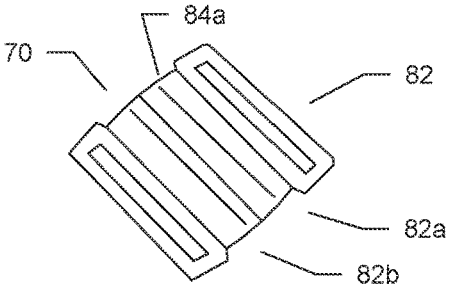

FIG. 5J illustrates a two-portion magnetic clasp 82 having a first portion 82*a* with a first magnet 84*a* and a second portion 82*b* with a second magnet 84*b*. Two magnets 84*a*/*b* are engaged with opposite polarities aligned to make a magnetic coupling means. One portion may be sewn to cloth or fabric, the other may engage chain 50.

Figure 5K:
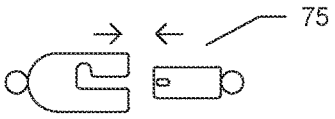
Figure 5L:
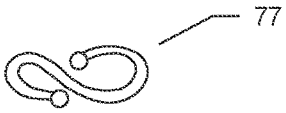
Figure 5M:
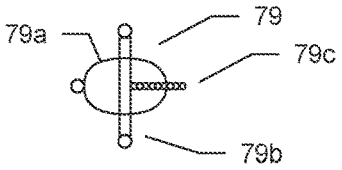

FIG. 5K illustrates a two-part bayonet clasp 75, FIG. 5L an "S" hook clasp (one piece, no moving parts) 77 and FIG. 5M illustrates a toggle clasp 79 having a loop 79*a* for releasably engaging a toggle 79*b* which is attached to a chain 79*c*.

Any of these clasps or clasp engagement means may be decorated with gems or may have other ornamental adornments. Other types of clasps are barrel clasps, box (pressure) clasps and spring clasps.

Thus, coupling means 70 may, in some embodiments comprise a clasp alone, when such a clasp is attached directly to cloth or fabric of the garment and can also releasably attach to a chain link as in the "two part" clasps.

Figure 6:
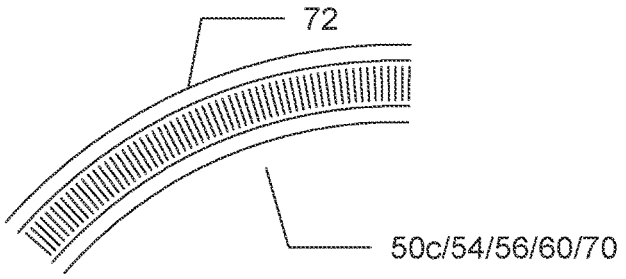
FIG. 6 illustrates a corrosion and abrasion resistant decorative coating that may be used with any metallic elements of Applicant's invention.

Illustrated in FIG. 6 is a protective and decorative coating that may be used in any of the metallic elements of applicant's invention such as chain links, clasps, and loops or coupling means. In some embodiments the coating is a conversion coating such as Alodine a hexavalent chromium conversion coating or TCP a trivalent chromium conversion coating, see U.S. Pat. Nos. 6,375,726 and 6,511,532, incorporated herein by reference that describes details of these two coatings. Both of these coatings resist saltwater corrosion and mechanical abrasion to maintain a pleasing appearance. Additional suitable coatings are anodized coatings, such as anodized aluminum and ceramic coatings, including tinted ceramics.

FIGS. 7A, B and C illustrate the manner and location in which chains and coupling means may be placed on a garment to decorate the garment. FIG. 7A illustrates top 12 having straps 18, 20*a* and 20*b*. Chain "A" has ends attached to neck strap 18 (or, not shown, shoulder straps 19*a* and 19*b*). Chain "B" shows chain ends attached to neck strap 18 and at least a non-end link member 52*c* attached somewhere else, here at front strap 22. Chain "C" is attached at both ends to a breast cup. Chain "D" is attached to a breast cup and somewhere else on the garment, here at strap 20*a*. Chain "E" is attached at either end to the adjacent breast cups. Chain "F" is attached at either end to front strap 22.

Figure 7B:
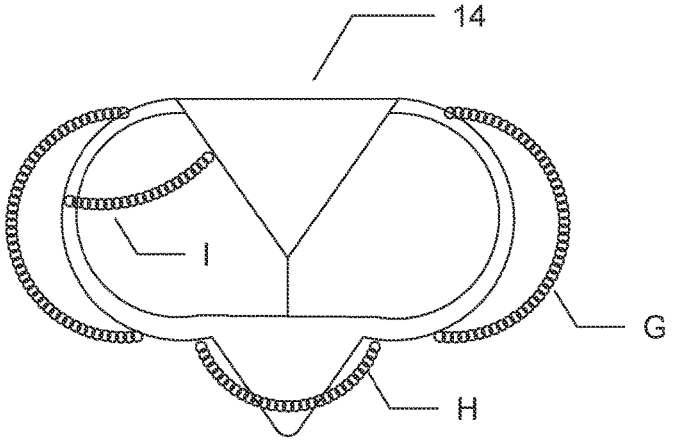
Figure 7I:
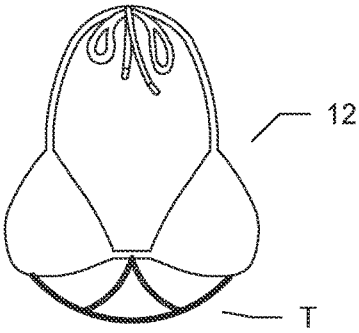

FIG. 7B shows two-piece bottom 14 where Chain "G" is attached at both ends to a side strap; Chain "H" at both ends to side straps and at a non-end link to the front panel; Chain "I" is attached from a side strap to the rear panel.

Figure 7J:
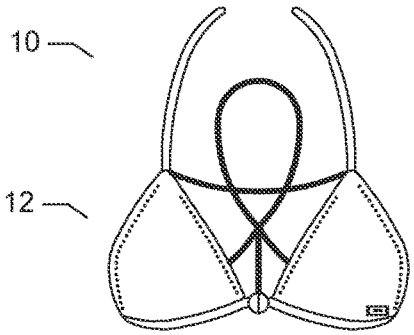
Figure 7K:
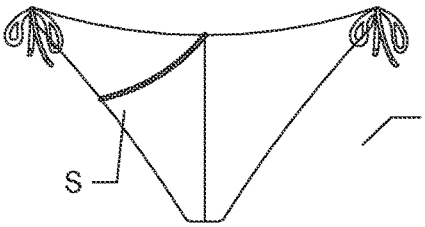
Figure 7L:
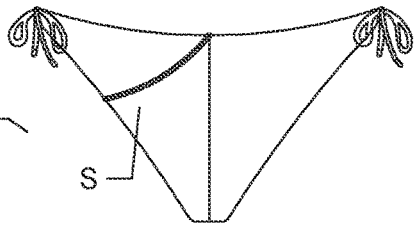
Figure 7M:
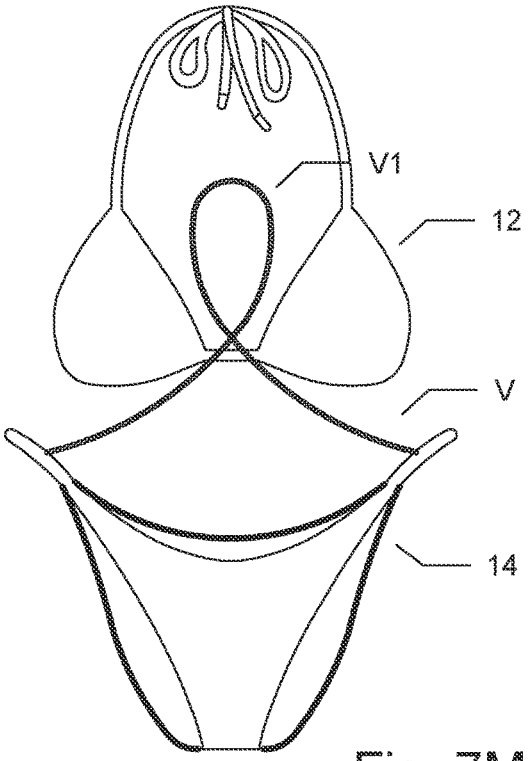
Figure 7N:
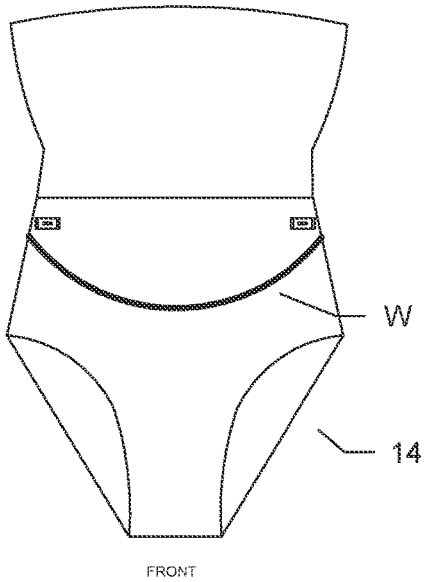

FIGS. 7C, 7D, 7E and 7F illustrate various configurations of top 12 of a two-piece showing chains "M", "$M^1$", "N", "O", "P" and "Q" engaged therewith (front views). FIGS. 7G and 7H are left and right-side views of a one-piece swimsuit 11 showing the location of a pair of chains "R". FIGS. 71 and 7J are rear and front views of a two-piece swimsuit 10 having top 12 and bottom 14 showing location of chain "S". FIG. 7K illustrates top 12 showing a branched chain, "T". FIG. 7L illustrates top 12 having chain assembly "U" comprising multiple chains, some engaged to other chains, some engaged to the top, some engaged to both other chains and the top and one dimensional to encircle the neck of the wearer. FIG. 7M illustrates chains "V" connecting top 12 to bottom 14 and "$V^1$" engaging top 12 while encircling the neck and providing some support to top 12. FIG. 7N illustrates chain "W" adorning the front of bottom 14 of a two-piece swimsuit.

In some embodiment's clasps may be "planer", meaning they may lay primarily in two dimensions, having a thickness of about 25% or less than the lesser of their longest length or width dimension. In some embodiments the weight of the chain is considered "lightweight" that is, between about 2 and 16 ounces between the endpoints, in some embodiments, "ultralight" between about 1 and 8 ounces. The light weight may reduce the pull on the garment.

A non-garment engaged chain may be engaged to a garment engaged chain by clasp 54, in some embodiments. See FIG. 8 chains "L" and "K" attached at both ends to the garment, "J" attaching at both ends to two different chains. Applicant's chains and coupling means can be used on any garments and on any cloth or fabric and at any locations to provide functional yet decorative attire.

Figure 8:
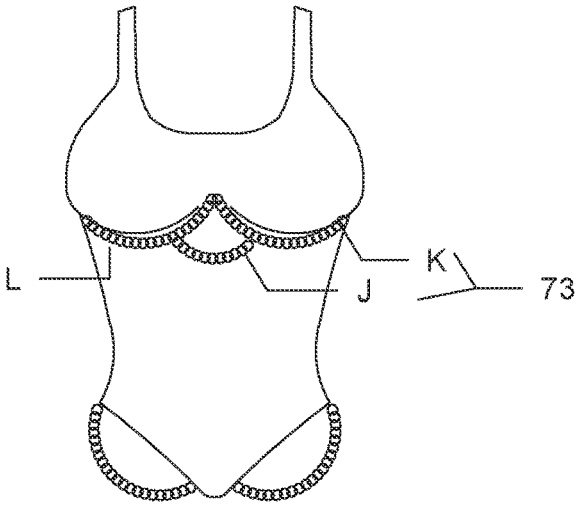
FIG. 8 illustrates chain attachment points on a one-piece women's swimsuit.

A chain assembly may be a chain with only two ends, see chain "A" FIG. 7A. It may be connected to the garment at one or both ends, as in FIG. 7A, or it may be attached to the garment at both ends and at a non-end link, see chain B, FIG. 7A. FIG. 8 shows a chain assembly where two chains with two ends are attached at non ends to a third chain "J" which does not attach to the garment directly.

In FIG. 8 it is shown that Chain "J" may be engaged at ends thereof to other chains, here "K" and "L" which in turn are attached to the garment by applicant's attachment means, thus providing a multichain assembly 73 which comprises multiple chains, only some of which are attached directly to the garment.

Figure 9A:
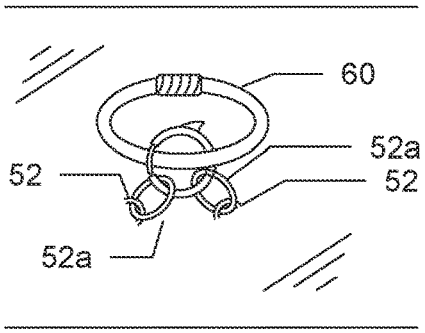
FIG. 9A illustrates a single coupling assembly engaging two chains.

FIG. 9A illustrates a single coupling assembly engaging two chains.

Figure 9B:
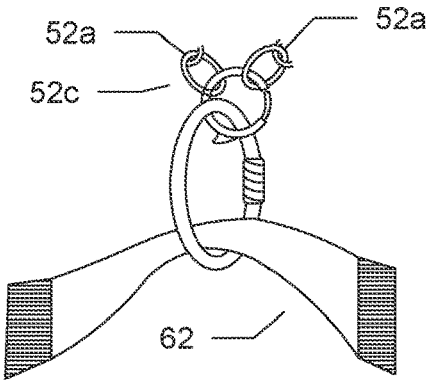
FIG. 9B illustrates a single coupling assembly engaging a body of a chain, rather than chain ends.

FIG. 9B illustrates a single coupling assembly engaging a body of a chain, rather than chain ends.

Some articles of clothing with which applicant's assembly may be applied are: swimsuits (one or multi-piece), sports bras and halter tops.

In the preceding description, for purposes of explanation, numerous details are set forth in order to provide a thorough understanding of the embodiments. However, it will be apparent to one skilled in the art that these specific details are not required. In other instances, well-known structures and components are shown in block diagram form in order not to obscure the understanding.

The above-described embodiments are intended to be examples only. Alterations, modifications, and variations can be affected to the particular embodiments by those of skill in the art. The scope of the claims should not be limited by the particular embodiments set forth in the examples but should be given the broadest interpretation consistent with the specification as a whole.

The invention claimed is:

1. An assembly for use with a swimsuit or other garment, the assembly comprising:

a flexible chain, and means for removably attaching the flexible chain to the garment;

wherein the flexible chain has two removed ends and wherein the means for removably attaching includes a clasp capable of engaging each of the removed ends of the flexible chain, and wherein the means for removable attaching comprises a clasp engagement means attached to a section of clothes or fabric of the swimsuit or other garment, further including a pocket dimensioned for fully covering the clasp engagement means while providing access to the clasp engagement means by the clasp and covering from view the clasp or the clasp engagement means; and wherein the pocket includes sewn edges defining a perimeter and unsewn edges defining a pocket opening.

2. The assembly of claim 1 wherein the clasp engagement means is a rigid member sewn to the section.

3. The assembly of claim 1 wherein the clasp engagement means is an elastic fabric member sewn to the section.

4. The assembly of claim 1 wherein the flexible chain includes multiple linked metal links.

5. The assembly of claim 4 wherein the metal links have a protective coating on the surface thereof.

6. The assembly of claim 1 wherein the clasp engagement means is attached to an inner surface of the clothes or fabric.

7. The assembly of claim 1 wherein the clasp engagement means is attached to an outer surface of the clothes or fabric.

8. The assembly of claim 1 wherein the assembly includes multiple chains.

9. The assembly of claim 8 wherein some of the multiple chains contain only a first clasp.

* * * * *